US005413810A

United States Patent [19]

Mastalski

[11] Patent Number: 5,413,810

[45] Date of Patent: May 9, 1995

[54] FABRICATING ELECTROSTATOGRAPHIC IMAGING MEMBERS

[75] Inventor: Henry T. Mastalski, Webster, N.Y.

[73] Assignee: Xerox Corporation, Stamford, Conn.

[21] Appl. No.: 176,973

[22] Filed: Jan. 3, 1994

[51] Int. Cl.[6] ..... B05D 1/02

[52] U.S. Cl. ..... 427/171; 427/264; 118/62; 118/64; 198/380; 198/811; 29/DIG. 78; 29/DIG. 81; 264/500; 264/129; 264/573

[58] Field of Search ..... 427/171, 264; 118/62, 118/68; 198/380, 811; 29/DIG. 78, DIG. 81; 264/500, 573, 129

[56] References Cited

U.S. PATENT DOCUMENTS

| | | | |
|---|---|---|---|
| 1,322,843 | 11/1919 | Townsend . | |
| 1,457,781 | 6/1923 | Loughead . | |
| 2,645,004 | 7/1953 | Dorner . | |
| 2,721,601 | 10/1955 | Spencer . | |
| 2,782,459 | 2/1957 | Moncrieff . | |
| 2,980,474 | 4/1961 | Gargan . | |
| 2,988,387 | 6/1961 | Eschmann et al. . | |
| 3,146,709 | 9/1964 | Bass et al. . | |
| 3,647,589 | 3/1972 | Felden . | |
| 3,695,757 | 10/1972 | Gregory | 353/3 |
| 3,797,889 | 3/1974 | Wilkinson | 198/380 |
| 3,846,901 | 11/1974 | Lovett | 29/450 |
| 3,900,941 | 8/1975 | Browning et al. . | |
| 3,930,684 | 1/1976 | Lasch, Jr. et al. | 198/380 |
| 4,332,073 | 6/1982 | Yoshida et al. . | |
| 4,378,622 | 4/1983 | Pinkston et al. . | |
| 4,599,783 | 7/1986 | Ceccacci . | |
| 4,664,995 | 5/1987 | Horgan et al. | 430/59 |
| 4,711,833 | 12/1987 | McAneney et al. | 430/131 |
| 4,747,992 | 5/1988 | Sypula et al. | 261/130 |
| 5,039,598 | 8/1991 | Abramsohn et al. | 430/347 |
| 5,073,434 | 12/1991 | Frank et al. | 428/195 |
| 5,083,657 | 1/1992 | Kelsey | 198/811 |
| 5,091,278 | 2/1992 | Teuscher et al. | 430/58 |
| 5,100,628 | 3/1992 | Griffiths et al. | 427/121 |
| 5,120,628 | 6/1992 | Mammino et al. | 430/59 |
| 5,143,573 | 9/1992 | Ammon et al. | 156/294 |
| 5,167,987 | 12/1992 | Yu | 427/171 |

FOREIGN PATENT DOCUMENTS

| | | | |
|---|---|---|---|
| 0003051 | 7/1979 | European Pat. Off. . | |
| 0246627 | 11/1987 | European Pat. Off. . | |
| 0406172 | 1/1991 | European Pat. Off. . | |
| 2949164 | 6/1980 | Germany . | |
| 2939089 | 4/1981 | Germany | 29/DIG. 78 |
| 3-144458 | 1/1991 | Japan . | |

OTHER PUBLICATIONS

Xerox Disclosure Journal, vol. 17, No. 2 Mar./Apr. 1992, pp. 95–96.

H. T. Masatalski, "Continuous Horizontal Coating System", Xerox Disclosure Journal, vol. 17, No. 2, Mar./Apr. 1992.

*Primary Examiner*—Shrive Beck
*Assistant Examiner*—Brian K. Talbot
*Attorney, Agent, or Firm*—Oliff & Berridge

[57] ABSTRACT

A seamless belt is fabricated by application of a coating to an endless substrate. The substrate is elastically stretched over a hollow cylindrical elongated support mandrel. The mandrel is formed of a porous material. Fluid is applied under pressure through the mandrel to form a layer of fluid between the outer surface of the mandrel and the inner surface of the substrate. The flow of fluid is manipulated to axially displace and to rotate the substrate on the outer surface of the mandrel. The flow of fluid is manipulated to orient a selected portion of the surface of the substrate to an angle to a direction of application of a coating. The temperature of fluid is manipulated to assist in substrate temperature control at steps of the coating and drying process.

21 Claims, 3 Drawing Sheets

FABRICATING ELECTROSTATOGRAPHIC IMAGING MEMBERS

BACKGROUND OF THE INVENTION

This invention relates in general to electrostatography and, in particular, to a process for fabricating electrostatographic imaging members.

In electrostatography, an electrophotographic imaging member is imaged by first uniformly electrostatically charging its surface. The photosensitive imaging member is then exposed to a pattern of activating electromagnetic radiation such as light. The radiation selectively dissipates the charge in the illuminated areas of the photoconductive insulating layer, while leaving behind an electrostatic latent image in the nonilluminated areas. The electrostatic latent image is then developed to form a visible image by depositing finely divided electroscopic marking particles on the surface of the photoconductive insulating layer. The resulting visible image is transferred from the imaging member directly or indirectly to a support such as paper. This imaging process can be repeated many times with reusable imaging members.

The electrophotographic imaging member may be a plate, drum, belt or the like containing the photoconductive insulating layer on a conductive layer. This invention relates to a process for fabrication of substrates which are useful as photoreceptor belts for use in electrostatography.

Flexible organic photoreceptors in the form of belts are manufactured by coating a web and thereafter shearing the web into segments and forming the segments into belts by welding opposite ends. Since the resulting welded seam on the photoreceptor disrupts the continuity of the outer surface of the photoreceptor, the seam must be indexed so that it does not print out during imaging cycles. However, efficient stream feeding of paper and throughput are adversely affected because it is necessary to detect where the seam is located within the length of each sheet of paper. The mechanical and optical devices required for indexing add to the complexity and cost of equipment and reduce the available design flexibility. Welded belts are also less desirable for electrophotographic imaging systems because the seam forms a weak point in the belt and then collects toner debris during cleaning, particularly with wiper blade cleaning devices.

U.S. Pat. No. 4,711,833, to McAneney et al., Dec. 8, 1987, relates to a process for fabrication of a seamless belt. The process comprises providing a mandrel coated with a release coating, depositing a polymer by electrostatic spraying, melting the polymer and cooling the polymer. The resulting seamless belt is removed from the mandrel prior to or after application of a ground plane layer, photogenerating layer and charge generating layer. After formation of the coated or uncoated belt, air pressure is applied to the interior of the mandrel. The air passes through holes at one end of the mandrel to lift and break the adhesive bond between the inside surface of the seamless coated or uncoated belt and the surface. The air pressure is then released and the seamless coated or uncoated belt is slipped off the mandrel.

U.S. Pat. No. 4,747,992, to Sypula et al., May 31, 1988, relates to a process for forming a seamless belt comprising forming at least one thin uniform fluid coating of a film-forming polymer on a cylindrical mandrel having a larger mass, a lower thermal conductivity, or both a larger mass and a lower thermal conductivity than the film-forming polymer. The mandrel further has a critical surface tension greater than the surface tension of the fluid coating. The mandrel is coated and then both the mandrel and the coating are heated to a temperature above the apparent $T_g$ of the coating to expand the coating and mandrel. The coating is cooled below the apparent $T_g$ of the solid coating. The mandrel is then cooled whereby the mandrel contracts at a greater rate than the coating to effect separation between the mandrel and the coating. Fluid air or liquid may be introduced at one or both ends of the mandrel between the mandrel surface and the positive belt to reduce adhesion between the mandrel and the coating to facilitate removing the coating from the mandrel.

U.S. Pat. No. 5,100,628, to Griffiths et al., Mar. 21, 1992, teaches a method and apparatus for coating photoreceptors. Prior to coating, an elastically deformable material is placed around the external surface of an mandrel to accommodate a belt. The thickness of the mandrel is such that when the belt is placed, the deformable material is deformed and engages the interior surfaces of the belt facing the mandrel. As a result of heating and cooling during the coating process, the belt contracts and expands at a different rate than the mandrel. After coating, the coated belt is removed.

U.S. Pat. No. 5,167,987, to Yu, Dec. 1, 1992, relates to a process for fabricating an electrostatographic imaging member wherein a flexible substrate of a solid thermoplastic polymer is provided. An imaging layer coating including a film forming polymer is formed on the substrate. The coating and substrate are heated, then cooled. Sufficient predetermined biaxial tension is applied to the substrate while the energy layer coating and substrate are at a temperature greater than the glass transition temperature of the imaging layer coating. Application of the biaxial tension substantially compensates for all dimensional thermal contraction mismatches between the substrate and the imaging layer during cooling.

Japanese Laid-Open Patent Application No. 3-144458, Jun. 19, 1991, discloses a method of removing a coated membrane at the end of a drum wherein a laser beam is used to irradiate the membrane at a wavelength capable of burning and sublimating a coating formed on the outer circumferential surface of the drum. A suctioning device is disposed at the lower end of the drum to aid in removing the membrane from the drum surface.

Xerox Disclosure Journal, Vol. 17, No. 2, March/April, 1992, pages 95–96, discloses a continuous horizontal coating system for the manufacture of organic and alloy coated photoreceptors. The system inludes various stations arranged in succession. The stations provide for operations such as material handling, vacuum and/or spray deposition, substrate drying and load/unload steps. The system provides for transporting a workpiece along a guide path via a linear motion system. The linear motion system may include an air film suspension/rotation/axial displacement system.

Copending U.S. Patent Application, Ser. No. 08/176,380, to Mastalski et al., filed on the same day as the present application, discloses a method of treating seamless belt substrates. An endless belt is elastically stretched over a hollow porous cylindrical support mandrel by supplying a pressurized fluid through the mandrel. The pressure is then relieved, so that the belt is in close mechanical and thermal contact with the mandrel. The belt is treated by the application of coatings. After treatment of the belt, pressurized fluid is again supplied through the mandrel to stretch the belt and to remove the belt from the mandrel.

The present invention relates to an improved process for fabricating seamless substrates which are useful as photoreceptor belts in photostatography. More particularly, the invention relates to a process of forming a seamless belt while mounted on a mandrel.

SUMMARY OF THE INVENTION

The invention provides a process for fabrication of a seamless belt by application of a coating to an endless substrate, comprising: (1) elastically stretching an endless substrate over a hollow cylindrical elongated support mandrel, the mandrel being formed of a porous material; (2) applying fluid under pressure through the mandrel to form a layer of fluid between an outer surface of the mandrel and an inner surface of the substrate; (3) manipulating the flow of the fluid to axially displace and to rotate the substrate on the outer surface of the mandrel; and (4) manipulating the flow of the fluid to orient a selected portion of a surface of the substrate at an angle to a direction of application of a coating.

Additionally, the present invention provides a system for coating a substrate, comprising; (A) a rigid elongated mandrel having a longitudinal axis and a perforated surface, (B) a plurality of operation stations positioned along the longitudinal axis of the mandrel, and (C) a plurality of fluid delivery lines located within the elongated mandrel for selectively supplying fluid to portions of the mandrel.

DESCRIPTION OF PREFERRED EMBODIMENTS

Figure 1:
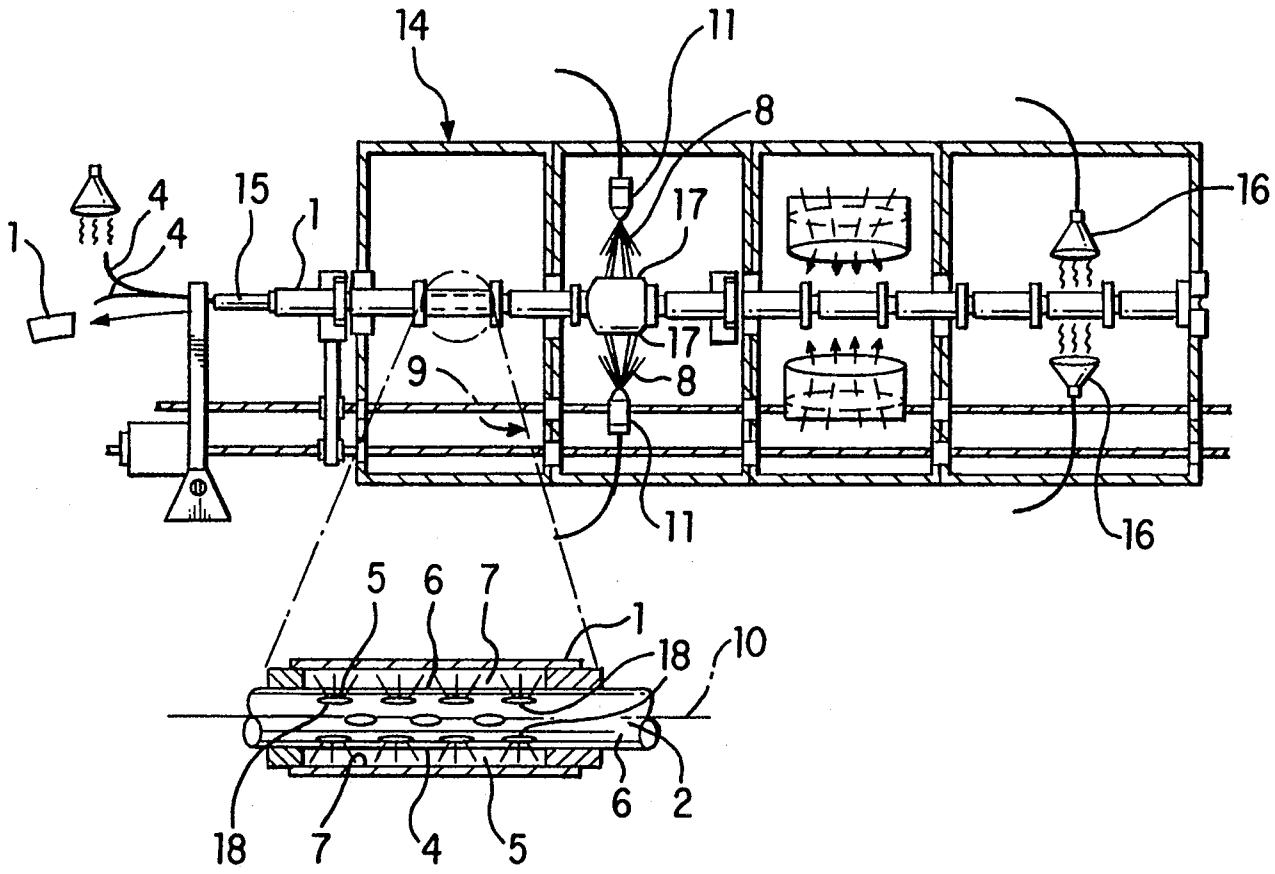
FIG. 1 is a schematic representation of a coating system for fabrication of a seamless belt.
Figure 2:
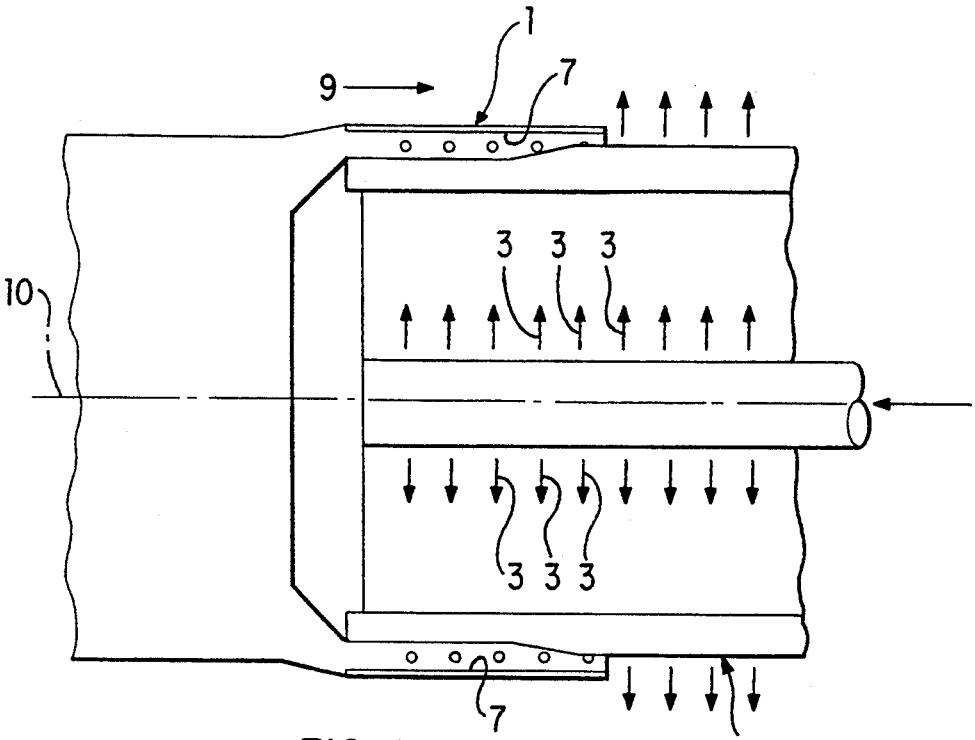
FIG. 2 is a schematic representation of an endless substrate as it is elastically stretched over a hollow, cylindrical, elongated support mandrel.
Figure 3:
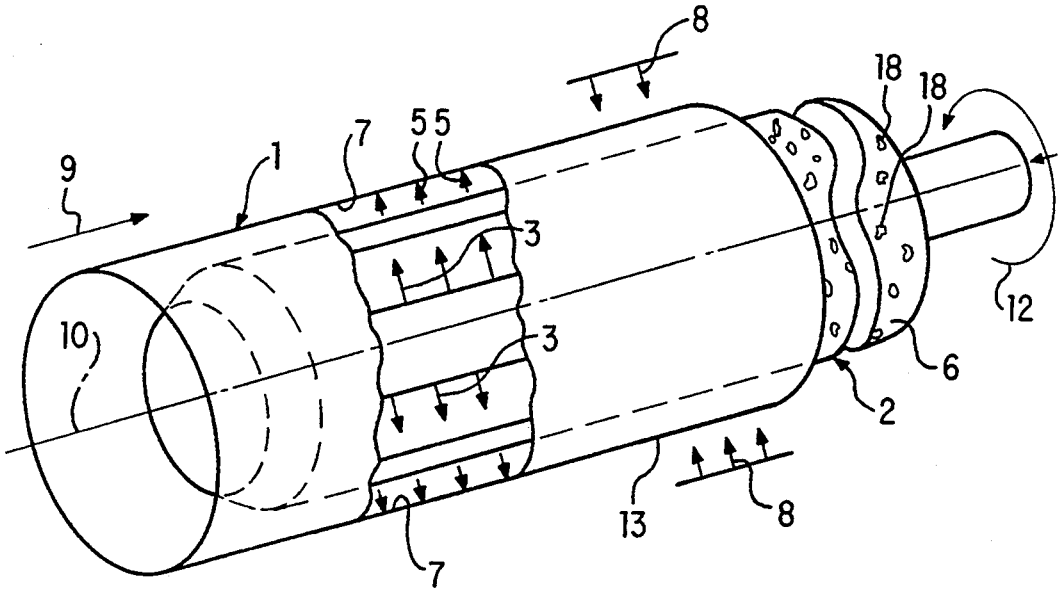
FIG. 3 is a schematic representation of an endless substrate loaded and then positioned on the outer surface of a mandrel for the application of a coating.

As illustrated in FIGS. 1, 2 and 3, a seamless flexible belt is fabricated by a process wherein an endless substrate 1 is elastically stretched over a hollow, cylindrical, elongated support mandrel 2. A fluid 3 is applied under pressure through the mandrel 2 by lines 4 to form a layer 5 of fluid between an outer surface 6 of the mandrel 2 and an inner surface 7 of the substrate 1. The flow of fluid is manipulated to position the substrate 1 oil the outer surface 6 of the mandrel 2, and a coating is applied 8 to the substrate 1 as positioned by the manipulating step.

Flow of fluid accomplishes mounting and positioning of substrate 1 on mandrel 2 though a fluid bearing principle. A tightly fitting belt 1 is fitted to mandrel 2 and manipulated along the longitudinal axis of mandrel 2 by forcing compressed fluid through the pores of mandrel 2 against the inner surface 7 of substrate 1 to float the substrate 1 on a very thin cushion of fluid while stretching the belt within its elastic limit.

In the manipulating step, the fluid is controlled to cause the substrate 1 to advance (arrow 9) along longitudinal axis 10 of the mandrel 2. As the substrate 1 is advanced along the mandrel 2, it is positioned at various stations 11 (one shown) for the application 8 of coatings. At the stations 11, the fluid is controlled to cause the substrate 1 to rotate in direction 12 around the longitudinal axis 10 of the mandrel 2 while forming a uniform coating. The coating comprises film forming polymer material on the outer surface 13 of the substrate 1. In another embodiment, the fluid can be controlled to simultaneously advance the substrate 1 and to rotate the substrate 1 in direction 12 to position the substrate 1 to provide a best orientation for application 8 of coating.

As illustrated in FIG. 1, the process of fabricating a seamless flexible belt can be conducted in a continuous horizontal coating system 14. The system 14 houses various stations in succession where unit operations for material handling, vacuum and/or spray deposition, substrate drying and load/unload steps are accomplished in a continuous fashion. Substrate 1 is conveyed onto the coating system 14 along cylindrical guide 15. The substrate 1 is loaded onto mandrel 2 and is axially displaced along the longitudinal axis of mandrel 2 to various coating stations 11 and to various drying stations 16 (one shown).

At station 11, fluid is controlled to orient a selected portion 17 of the surface 13 of the substrate 1 to an angle to a direction of application 8 of coating. For example, while some spray applications require a normal angle application of coating to substrate for best results, a brushing operation may require application at angles less than 90°. A selected portion 17 of the substrate 1 can be manipulated by the application of fluid under pressure to accommodate the different requirements of different application processes. Fluid can be delivered to the substrate by a plurality of fluid delivery lines 4. Different fluid pressures can be applied to the lines 4 so as to apply different pressure to selected portion 17 of the substrate. The selected portion 17 is distorted from the substrate shape established by fluid flow for axial displacement and rotation. The selected portion 17 is distorted by manipulating fluid under a greater pressure or fluid directed at a different angle than the pressure or angle of manipulation of fluid required for axial displacement and rotation. The distorted portion 17 of substrate 1 is maniuplated by fluid under pressure to an angle to the direction of the coating application 8 required for best coating results.

Additionally, the temperature of fluid can be manipulated to control the temperature of substrate 1. The temperature of the fluid can be manipulated by heating the fluid applied in line 4 to control the temperature of substrate 1 at or near the temperature of the coating applied in a coating station 11 or at or near the temperature at a drying station 16. Again, a plurality of lines 4 can be utilized to deliver fluid and the lines can be arranged so that fluid at different temperatures can be delivered to different stations of the coating system 14.

The application step 8 can be controlled to apply fluid 3 under pressure through the mandrel 2 having pores 18 shaped to manipulate the flow for positioning of the substrate 1. The mandrel 2 can be provided with pores 18 formed in the mandrel 2 at an angle to the substrate 1 and/or arranged in various other configurations, such as a cork-screw, to permit control of the fluid for substrate positioning. Additionally, the substrate 1 may be treated or shaped to provide further control of the application of the fluid. The substrate may be surface treated, (for example, ablated), to affect fluid flow.

Any suitable material may be used as fluid. Exemplary fluids include air, oxygen, nitrogen and gas laden with a vapor of a coating solvent. The vapor can be a vapor of a solvent used in the application of the coating application or a vapor of a solvent with properties similar to the properties of the solvent used in the coating application.

Any suitable material can be used in the mandrel 2. The mandrel 2 should be dimensionally and thermally stable at the processing temperatures utilized. It also should be insoluble in any liquid carrier employed with the coating materials and should not react chemically with the coating material or other components thereof. Typical mandrel materials include metals such as aluminum, stainless steel, nickel, chromium, copper, brass, and the like. Typical polymeric mandrel materials include polyethylene, polypropylene, polymethylpentene, copolymers thereof, and the like. Typical ceramic mandrel materials include ceramic, glass, clay and the like. The mandrel 2 may be formed by extrusion, molding, injection molding, casting and the like to achieve the desired shape.

The endless substrate 1 is mounted to the mandrel 2 by supplying pressurized fluid through the porous mandrel 2. The outside diameter of the mandrel 2 is substantially the same as the inside diameter of the finished imaging member. The endless substrate 1 used to form the imaging member preferably has a dimension in the range of 5 to 15 inches in diameter (127–381 mm), by 10 to 15 inches wide (254–381 mm), by 1 to 10 mils thick (25–250 mm). Mounting the substrate 1 on the porous mandrel 2 is preferably accomplished by using a slightly tapered porous collar with a maximum diameter the same as that of the mandrel 2. The degree of taper is preferably about 10 degrees. Forcing compressed air through the pores 18 of the collar allows the belt 1 to expand to fit over the mandrel 2. After mounting, fluid is continuously forced through the porous mandrel 2 to provide a thin layer of fluid supporting the endless substrate 1. Thereafter, the endless substrate 1 is advanced along the longitudinal axis 10 of mandrel 2 to the various processing stations 11. At the various processing stations 11, layers are applied to the substrate 1 successively to provide the electrostatographic imaging member. Further, at each station 11, the substrate 1 can be rotated around the longitudinal axis 18 of mandrel 2 and/or angled to provide the best orientation for applying the particular layer.

The layers applied to the substrate in fabricating the electrostatographic imaging member may comprise a blocking layer, an adhesive layer, a photoconductive layer or a combination of these layers with or without additional layers. The layers can be formed on the substrate by deposit from solutions, dispersions, emulsions or powders by any suitable technique. However, the deposited coating should form a thin substantially uniform fluid coating on the substrate prior to solidifying. Typical techniques for depositing coatings include spray coating, dip coating, wire wound rod coating, powder coating, electrostatic spraying, sonic spraying, blade coating, and the like.

Figure 4:
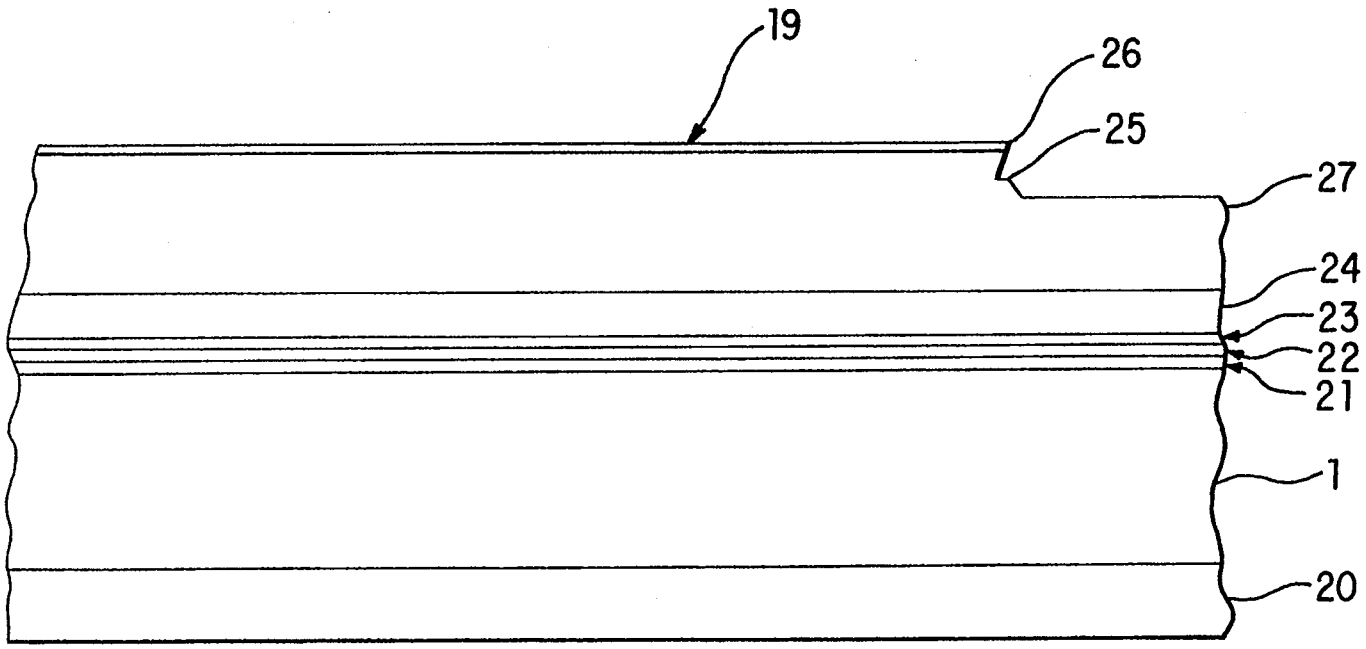
FIG. 4 is a cross-sectional view of a multilayer photoreceptor belt fabricated by the process of the invention.

The electrophotographic imaging member 19 shown in FIG. 4 includes an anti-curl layer 20, a supporting substrate 1, an electrically conductive ground plane 21, a charge blocking layer 22, an adhesive layer 23, a charge generating layer 24, a charge transport layer 25 and an overcoating layer 26. The layers of the electrophotographic imaging member 19 and the method for producing the electrophotographic imaging member 19 are described as follows:

The Supporting Substrate

The supporting substrate 1 may be may be any suitable composition in the form of an endless belt. The substrate 1 may be opaque or substantially transparent and may comprise numerous suitable materials having the required mechanical properties. The substrate 1 may further be provided with an electrically conductive surface (ground plane). Accordingly, the substrate 1 may comprise a layer of an electrically nonconductive or conductive material such as an inorganic or an organic composition. As electrically non-conducting materials, various resins known for this purpose, including polyesters, polycarbonates, polyamides, polyurethanes, and the like, may be used. The substrate 1 in the form of an endless flexible belt may comprise a commercially available biaxially oriented polyester known as Mylar, available from E.I. du Pont de Nemours & Co., or Melinex available from ICI Americas Inc.

The preferred thickness of the substrate layer 1 depends on numerous factors, including economic considerations. The thickness of this layer may range from about 65 micrometers to about 150 micrometers, and preferably from about 75 micrometers to about 125 micrometers for optimum flexibility and minimum induced surface bending stress when cycled around small diameter rollers, e.g., 19 millimeter diameter rollers. The substrate for a flexible belt may be of substantial thickness, for example, 200 micrometers, or of minimum thickness, for example 50 micrometers, provided there are no adverse effects on the final photoconductive device. The surface of the substrate layer 1 is preferably cleaned prior to coating to promote greater adhesion of the deposited conductive coating. Cleaning may be effected by exposing the surface of the substrate layer to plasma discharge, ion bombardment and the like.

The Electrically/Conductive Ground Plane

The electrically conductive ground plane 21 (if needed) may be an electrically conductive layer such as a metal layer which may be formed, for example, on the substrate 1 by any suitable coating technique, such as a vacuum depositing technique. Typical metals include aluminum, zirconium, niobium, tantalum, vanadium, hafnium, titanium, nickel, stainless steel, chromium, tungsten, molybdenum, and the like, and mixtures and alloys thereof. The conductive layer 21 may vary in thickness over substantially wide ranges depending on the optical transparency and flexibility desired for the electrophotoconductive member. Accordingly, for a flexible photoresponsive imaging device, the thickness of the conductive layer 16 is preferably between about 20 Angstroms (about 0.005 microns) to about 750 Angstroms (about 0.075 microns), and more preferably from about 50 Angstroms (about 0.005 microns) to about 200 Angstroms (about 0.02 microns) (for an optimum combination of electrical conductivity, flexibility and light transmission.

Regardless of the technique employed to form a metal layer, a thin layer of metal oxide generally forms on the outer surface of most metals upon exposure to air. Thus, when other layers overlying the metal layer are characterized as "contiguous" layers, it is intended that these overlying contiguous layers may, in fact, contact a thin metal oxide layer that has formed on the outer surface of the oxidizable metal layer.

Generally, for rear erase exposure, a conductive layer light transparency of at least about 15 percent is desirable. The conductive layer need not be limited to metals. Other examples of conductive layers are combinations of materials such as conductive indium tin oxide as a transparent layer for light having a wavelength between about 4000 Angstroms and about 9000 Angstroms or a conductive carbon black dispersed in a plastic binder as an opaque conductive layer.

Coating

After deposition of any electrically conductive ground plane layer 16, a charge blocking layer 22 may be applied thereto. Electron blocking layers for positively charged photoreceptors allow holes from the imaging surface of the photoreceptor to migrate toward the conductive layer. For negatively-charged photoreceptors, any suitable charge blocking layer capable of forming a barrier to prevent hole injection from the conductive layer to the photoconductive layer may be utilized.

The blocking layer 22 may be applied by any suitable conventional technique such as spraying, dip coating, draw bar coating, gravure coating, silk screening, air knife coating, reverse roll coating, vacuum deposition, chemical treatment and the like. For convenience in obtaining thin layers, the blocking layer 22 is preferably applied in the form of a dilute solution, with the solvent being removed after deposition of the coating by conventional techniques such as by vacuum, heating and the like. Generally, a weight ratio of blocking layer material and solvent of between about 0.05:100 to about 0.5:100 is satisfactory for spray coating.

An intermediate layer 23 between the blocking layer 22 and the charge generating or photogenerating layer 24 may be desired to promote adhesion. If such layer is utilized, preferably it has a dry thickness between about 0.01 micrometer to about 0.3 micrometer, more preferably about 0.05 to about 0.2 micrometer.

The adhesive layer 23 may comprise any known adhesive for layers of an electrophotographic imaging member, including film-forming polymers such as polyester, du Pont 49,000 resin (available from E.I. du Pont de Nemours & Co.), Vitel PE-100 (available from Goodyear Rubber & Tire Co.), polyvinylbutyral, polyvinylpyrrolidone, polyurethane, polymethyl methacrylate, or the like. Both the du Pont 49,000 and Vitel PE-100 adhesive layers are preferred because they provide reasonable adhesion strength and produce no deleterious electrophotographic impact on the resulting imaging members.

A Charge Generating (Photogenerating) Layer 24 may be applied onto the adhesive layer 23 or directly onto the charge blocking layer 22 if an adhesive layer 23 is not used. A charge transport layer 25 may be applied onto the charge generating layer 24. The charge transport layer 25 may comprise any suitable transparent organic polymer or nonpolymeric material capable of supporting the injection of photogenerated holes or electrons from the charge generating layer 24 and allowing the transport of these holes or electrons through the organic layer to selectively discharge the surface charge. The charge transport layer not only serves to transport holes or electrons, but also protects the charge generating layer from abrasion or chemical attach and therefore extends the operating life of the imaging member.

Examples of materials for the photogenerating layer and the charge transport layer (as well as for the other layers of the imaging member) are provided, for example, in U.S. Pat. No. 5,091,278 to Teuscher et al., and in U.S. Pat. No. 5, 120,628 to Mammino et al. The disclosures of these patents are incorporated herein by reference.

Any suitable and conventional technique may be utilized to mix and thereafter apply the photogenerating layer coating mixture and the charge transport layer coating mixture to the previously applied layer. Typical application techniques include spraying, dip coating, roll coating, wire wound rod coating, and the like. Drying of the deposited coating may be effected by by any suitable conventional technique such as oven drying, infra-red radiation drying, air drying and the like, to remove substantially all solvents utilized in applying the coating.

The photogenerating layer 24 generally ranges in thickness from about 0.1 μm to about 5.0 μm, preferably, from about 0.3 μm to about 3 μm. The photogenerating layer thickness is related to binder content. Higher binder content compositions generally require thicker layers to give equivalent pigment coverage for identical photogeneration capability. Thickness is outside these ranges can be selected, provided the objectives of the present invention are achieved.

The thickness of the charge transport layer 25 may range from about 10 micrometers to about 50 micrometers, and preferably from about 20 micrometers to about 35 micrometers. Optimum thicknesses may range from about 23 micrometers to about 31 micrometers.

In accordance with the present invention, the flow of fluid is manipulated to position the substrate 1 for the application of the respective charge blocking layer 22, adhesive layer 23, photogenerating layer 24, and charge transport layer 25. Further, the flow of fluid is applied to transport the substrate with layers along the longitudinal axis of the mandrel to various other stations including stations 11 for the application of coatings and stations 16 for drying the coatings.

A ground strip 27 may comprise a film-forming polymer binder and electrically conductive particles. Cellulose may be used to disperse the conductive particles. Any suitable electrically conductive particles may be used in the electrically conductive ground strip layer 27. The ground strip 27 may comprise materials which include those enumerated in U.S. Pat. No. 4,664,995. Typical electrically conductive particles include carbon black, graphite, copper, silver, gold, nickel, tantalum, chromium, zirconium, vanadium, niobium, indium tin oxide and the like. The electrically conductive particles may have any suitable shape. Typical shapes include irregular, granular, spherical, elliptical, cubic, flake, filament, and the like. Preferably, the electrically conductive particles should have a particle size less than the thickness of the electrically conductive ground strip layer to avoid an electrically conductive ground strip layer having an excessively irregular outer surface. An average particle size of less than about 10 micrometers generally avoids excessive protrusion of the electrically conductive particles at the outer surface of the dried ground strip layer and ensures relatively uniform dispersion of the particles throughout the matrix of the dried ground strip layer. The concentration of the conductive particles to be used in the ground strip depends on factors such as the conductivity of the specific conductive particles utilized.

The ground strip layer 27 may have a thickness from about 7 micrometers to about 42 micrometers, and preferably from abut 14 micrometers to about 27 micrometers.

The anti-curl layer 20 is optional, and may comprise organic polymers or inorganic polymers that are electrically insulating or slightly semi-conductive. The anti-curl layer provides flatness and/or abrasion resistance.

Anti-curl layer 20 may be formed at the back side of the substrate 1, opposite to the imaging layers. The anti-curl layer may comprise a film-forming resin and an adhesion promoter polyester additive. Examples of film- forming resins include polyacrylate, polystyrene, poly(4,4'-isopropylidene diphenyl carbonate), 4,4'-cyclohexylidene diphenyl polycarbonate, and the like. Typical adhesion promoters used as additives include 49,000 (du Pont), Vitel PE-100, Vitel PE-200, Vitel PE-307 (Goodyear), and the like. Usually from about 1 to about 15 weight percent adhesion promoter is selected for film-forming resin addition. The thickness of the anti-curl layer is from about 3 micrometers to about 35 micrometers, and preferably about 14 micrometers. The anti-curl layer 15 may be applied to the inner surface 6 of substrate 1 after removal of the substrate 10 from mandrel 2.

The optional overcoating layer 26 may comprise organic polymers or inorganic polymers that are capable of transporting charge through the overcoat. The overcoating layer may range in thickness from about 2 micrometers to about 8 micrometers, and preferably from about 3 micrometers to about 6 micrometers. An optimum range of thickness is from about 3 micrometers to about 5 micrometers.

Any of the coating materials comprising film forming polymers may be deposited on the substrate 1 from solutions, dispersions, emulsions or powders by any suitable technique. However, the deposited coating should form a thin substantially uniform fluid coating on the substrate 1 prior to solidification of the coating. Typical techniques for depositing coatings include spray coating, dip coating, wire wound rod coating, powder coating, electrostatic spraying, sonic spraying, blade coating, and the like. If the coating is applied by spraying, spraying may be effected with or without the aid of a gas. Spraying may be assisted by mechanical and/or electrical aids such as in electrostatic spraying.

A typical spray gun that may be employed in the process of this invention comprises a central fluid nozzle surrounded closely by an annular concentric air nozzle. The fluid is forced out through the fluid nozzle either by the vacuum created by gas flow through the annular concentric nozzle or by pressurizing the fluid container. Primary atomization (dispersion of fluid droplets) takes place at the exit from the fluid nozzle. Secondary atomization (finer dispersion) occurs at the impingement of the annular gas stream with the fluid droplet dispersion. Further atomization and shaping of the spray pattern is produced by gas jets at greater distances from the fluid nozzle. The shape of the spray pattern can be varied from circular to elliptical by gas pressure applied through apertures and impinging at an angle to the main droplet stream. A typical spray gun having these features is a Model 21 spray gun available from Binks Company, Franklin Park, Ill.

It is preferred for optimum uniform coating of the substrate 1 that the substrate is rotated about the longitudinal axis of the mandrel and the spray gun is traversed in a direction parallel to the mandrel axis. Materials and process parameters are interdependent in a spray coating operation. Some of the process parameters include propellant gas pressure, solution flow rate, secondary gas nozzle pressure, gun to substrate distance, gun traversal speed and mandrel rotation rate. Materials parameters include, for example, solvent mixtures which affect drying characteristics, the concentration of dissolved solids, the composition of the dissolved solids (e.g. monomer, polymer), and the concentration of dispersed solids when dispersions or solutions are utilized. The deposited coating should be uniform, smooth, and free from blemishes such as entrained gas bubbles and the like.

The coating solutions that are applied by spraying are normally prepared by dissolving polymer in a blend of low and high boiling solvents. The low boiling point solvent flashes off rapidly during spraying to form a high viscosity film on the substrate 1. The remaining high boiling point solvent allows the sprayed coating to flow and dry slowly to a uniform smooth film; minimizes trapped air from forming bubbles when subsequently heated; and prevents "blushing" due to condensation of water from low boiling solvents evaporating too rapidly. Combinations of low and high boiling point solvents include methylene chloride and 1,1,2-trichloroethane; methylethyl ketone and methylisobutyl ketone; isopropanol and isobutyl alcohol; methanol and water; tetrahydrofurane and toluene and the like. Satisfactory results may be obtained with a mixture of from about 40 percent to 80 percent by weight low boiling solvent and 20 percent to 60 percent by weight high boiling solvent. A low boiling solvent is defined herein as a solvent having a boiling point less than about 80° C. and a high boiling system is defined herein as a solvent having a boiling point of at least about 100° C. It is preferred that the low boiling solvent also have a high evaporation rate, for example, methlene chloride has a low boiling point and a high evaporation rate and 1,1,2-trichloroethane has a high boiling point and a low evaporation rate. Excellent results have been obtained, for example, with a polycarbonate film forming polymer in a solvent containing about 45 percent by weight methylene chloride and about 55 percent by weight 1,1,2-trichloroethane.

The process of this invention is capable of preparing seamless organic photoreceptors comprising a seamless endless substrate, conductive ground plane and one or more photoconductive layers. The process of this invention may be used to prepare a seamless electrostatographic imaging member at multiple stations while reducing or eliminating handling and cleaning between deposition of various layers. This results in improvements in yield and reduces the cost by minimizing sources of contamination and defects.

What is claimed is:

1. A process for fabrication of a seamless belt by application of a coating to an endless substrate, comprising:

(1) elastically stretching an endless substrate over a hollow cylindrical elongated support mandrel, said mandrel being formed of porous material;

(2) applying fluid under pressure through said mandrel to form a layer of fluid between an outer surface of said mandrel and an inner surface of said substrate;

(3) manipulating the flow of said fluid to axially displace and to rotate said substrate on the outer surface of said mandrel; and (4) manipulating the flow of said fluid to orient a selected portion, less than an entire surface of said substrate, to alter an angle of said portion in relationship to the surface of said mandrel to an angle according to a direction of application of a coating to achieve a coating angle necessary for producing optimal coating results.

2. The process of claim 1, comprising forming at least one substantially uniform coating comprising a film forming polymer material on the outer surface of said substrate while manipulating said fluid according to steps (3) and (4).

3. The process of claim 1, comprising forming at least one substantially uniform coating comprising a film forming polymer material on the outer surface of said substrate while manipulating the flow of fluid to simultaneously rotate said substrate and to orient a selected portion of said substrate at an angle to the direction of application of coating.

4. The process of claim 1, comprising repeating said manipulating steps (3) and (4) to form at least an electrically conductive coating, a charge generator coating and a charge transport coating on the outer surface of said substrate.

5. The process of claim 4, comprising manipulating the flow of said fluid to axially displace substrate along a longitudinal axis of said mandrel to a plurality of stations at which said electrically conductive coating, charge generator coating and charge transport coating are successively applied.

6. The process of claim 1, comprising successively applying a plurality of coatings to said substrate after or during the manipulating steps (3) and (4) to position said substrate.

7. The process of claim 6, comprising drying said coatings between the steps of applying said coatings.

8. The process of claim 6, comprising applying a charge blocking layer over a substrate, applying a charge generating layer over said charge blocking layer and applying said charge transport layer over said charge generating layer.

9. The process of claim 8, wherein said coating is formed by spraying said rotating substrate with a spray gun traversing in a direction parallel to the axis of said mandrel while said substrate is rotated.

10. The process of claim 1, wherein said applying step comprises applying fluid under pressure through a mandrel having pores arranged to manipulate the flow of said fluid to position said substrate.

11. The process of claim 10, wherein said pores are positioned at an angle to said substrate.

12. The process of claim 10, wherein said pores are arranged in corkscrew along an outer surface of the support mandrel.

13. The process of claim 1, wherein said manipulating steps (3) and (4) comprise providing a substrate with an ablated surface to thereby manipulate the flow of said fluid to position said substrate.

14. The process of claim 13, wherein said applying step comprises applying fluid under pressure through a mandrel having a shaped porosity thereby manipulating the flow of said fluid in combination with said ablated substrate surface to position said substrate.

15. The process of claim 1, wherein said fluid is selected from the group consisting of air, oxygen, nitrogen and gas laden with a vapor of a coating solvent.

16. The process of claim 15, wherein said vapor is a vapor of a solvent used in the application of a coating according to step (4).

17. The process of claim 1, comprising (5) manipulating temperature of said fluid to control temperature of said substrate.

18. The process of claim 17, comprising forming at least one substantially uniform coating on an outer surface of said substrate while manipulating the temperature of said fluid according to step (5).

19. The process of claim 18, comprising (5) manipulating temperature of said fluid to control temperature of said substrate at or near a temperature of said coating.

20. The process of claim 18, comprising drying said coating subsequent to the step of forming the coating on an outer surface of said substrate.

21. The process of claim 20, comprising (5) manipulating temperature of said fluid to control temperature of said substrate at or near a temperature of said drying step.

* * * * *